US008573396B2

(12) United States Patent
Brownell

(10) Patent No.: US 8,573,396 B2
(45) Date of Patent: Nov. 5, 2013

(54) MARKING PACKAGES

(75) Inventor: Jennifer J. Brownell, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 300 days.

(21) Appl. No.: 13/182,482

(22) Filed: Jul. 14, 2011

(65) Prior Publication Data

US 2012/0012490 A1 Jan. 19, 2012

Related U.S. Application Data

(60) Provisional application No. 61/364,835, filed on Jul. 16, 2010.

(51) Int. Cl.
*B65D 85/00* (2006.01)

(52) U.S. Cl.
USPC ..... 206/459.5

(58) Field of Classification Search
USPC ..... 206/459.5, 459.1, 457, 484; 229/87.06; 383/106, 107
See application file for complete search history.

(56) References Cited

U.S. PATENT DOCUMENTS

| | | | | |
|---|---|---|---|---|
| 3,891,138 | A | 6/1975 | Glas | |
| 5,191,979 | A * | 3/1993 | Nemeroff | 206/459.5 |
| 5,881,883 | A | 3/1999 | Siegelman | |
| 6,050,407 | A * | 4/2000 | Trujillo | 206/320 |
| 6,491,160 | B2 | 12/2002 | Butler et al. | |
| 6,502,986 | B1 | 1/2003 | Bensur et al. | |
| 6,682,469 | B1 | 1/2004 | Knoerzer | |
| 7,594,348 | B2 | 9/2009 | Oosterlinck | |
| 2002/0117410 | A1 * | 8/2002 | Butler et al. | 206/312 |
| 2006/0285781 | A1 | 12/2006 | Zoss | |
| 2012/0152783 | A1 * | 6/2012 | Cheema et al. | 206/459.5 |
| 2012/0305639 | A1 * | 12/2012 | Ambrefe, Jr. | 235/375 |

* cited by examiner

*Primary Examiner* — Jacob K Ackun
(74) *Attorney, Agent, or Firm* — John L. Crimmins

(57) ABSTRACT

A flexible sidewall of a package has an inner surface that directly interfaces with product that is contained within an enclosed volume of the package. A sealed closure of the sidewall contains a material that forms a mark on the package, the mark being visible from an outer surface of the package. A production line can form a plurality of the packages, in sequence, after the mark is formed on the sidewall of each package. An outer package of a packaged product can contain a quantity of product and the aforementioned package, such that the outer surface of the package interfaces with the quantity of product. The material forming the mark on the package, being contained within the sealed closure thereof, is not exposed to the product that is contained therein, nor to the quantity of product contained in the outer package.

25 Claims, 4 Drawing Sheets

MARKING PACKAGES

CROSS-REFERENCE TO RELATED APPLICATIONS

This application claims the benefit to priority under 35U.S.C. 119(e)(1) of a provisional patent application, Ser. No. 61/364,835, filed Jul. 16, 2010, which is incorporated herein by reference in its entity.

TECHNICAL FIELD

Embodiments of the present invention pertain to packaging and packaged products and more particularly to the marking of individual packages.

BACKGROUND

Many consumer packaged products utilize flexible sheet-like materials or films that are formed into pouch-like packages that have one or more sealed closures and enclose a volume, which contains all or a portion of the product. When a product includes a plurality of types of elements, one or more inner packages can be employed to contain each type of element separately.

In order to minimize packaging material requirements, reduce an overall size/volume of the package and/or increase manufacturing flexibility in packaging a variety of offerings having at least one common type of element, it is desirable to enclose one of the plurality of elements directly within the outer package and the remaining one or more elements within one or more individual inner packages, such that an outer surface of each inner package directly interfaces with the one element enclosed directly within the outer package. However, compatibility of the outer surface of each inner package with the element enclosed directly within the outer package needs to be ensured, for example, if the one element is a substance that may be vulnerable to degradation and/or contamination that impairs the integrity thereof. Such elements include, for example, an edible material (i.e. food item), a pharmaceutical, a cleaning material, and a health and/or beauty material, any of which can be in a liquid, solid, semi-solid or particulate form. Alternately, or in addition, vulnerability of the integrity of an outer surface of each inner package to degradation by exposure to the element enclosed directly within the outer package should be considered.

BRIEF SUMMARY

Embodiments and methods of the present invention are designed to efficiently provide for the above-described desirable packaging, when marking of the one or more individual inner packages is necessary and/or desired, for example, for lot traceability and/or for providing information to the consumer and/or for decorative purposes. According to some preferred embodiments of the present invention, a package, which can be formed according to methods of the present invention, includes a mark formed by a material that is not exposed to either an element contained within the package nor to an element that is outside the package and with which the package directly interfaces, for example, when both the element and the package are contained within an outer package. In particular, an inner package and/or an outer package of a packaged product can include a mark formed by a material which is contained within a sealed closure of the package. In the following description, an element that is contained within a package, which is designated as an outer package of a packaged product, may be designated as a substance, and an element that is contained within a package, which is designated as an inner package contained within the outer package, may be designated as an item, for the purpose of distinguishing between the two. The terms "item" and "substance" are not intended to limit the scope of elements that can be packaged within either type of package and are only intended to correspond to two distinct volumes of a packaged product.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Each referenced patent or patent application is hereby incorporated by reference.

Figure 1B:
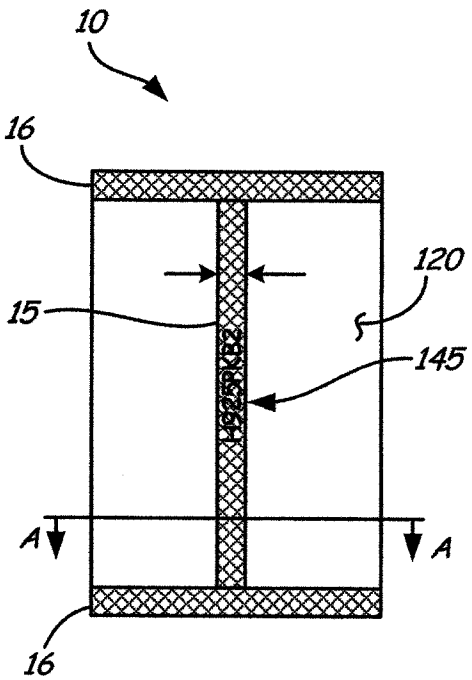
FIG. 1B is a plan view and a corresponding cross-section view of a package formed from the flexible sheet shown in FIG. 1A, according to some embodiments.
Figure 1B:
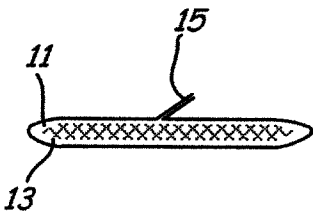
Figure 1A:
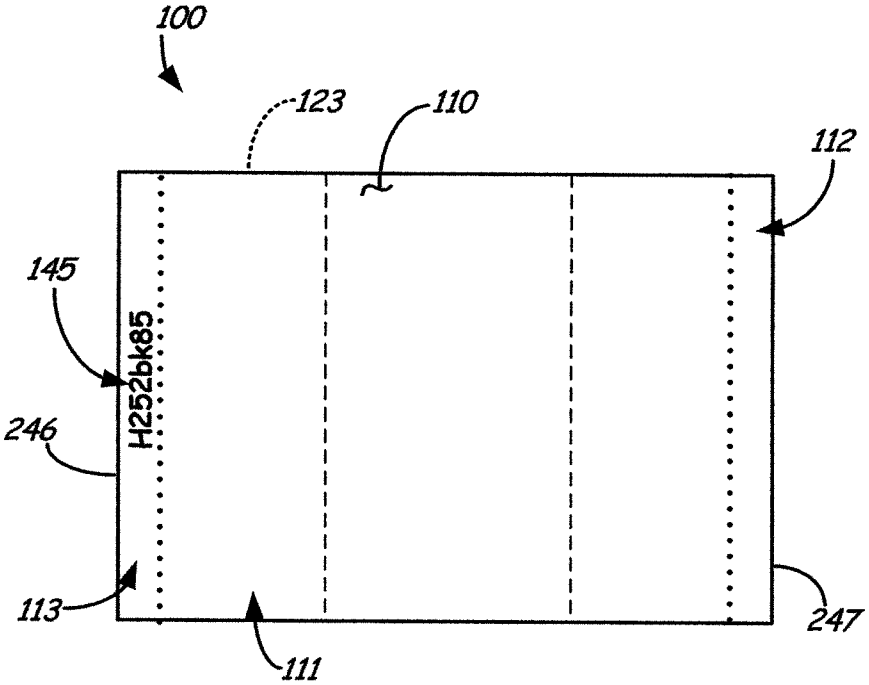
FIG. 1A is a plan view of a section or sheet fabricated from a flexible packaging material and including a mark formed thereon, according to some embodiments.

Referring now to the drawings, FIG. 1A is a plan view of a section or flexible sheet 100 fabricated from a flexible packaging material and having a mark 145 formed thereon, according to some embodiments; and FIG. 1B is a plan view and corresponding cross-section view, along section line A-A, of a package 10 formed from sheet 100, according to some embodiments. According to FIGS. 1A-B, sheet 100 forms a sidewall of package 10, having been wrapped or folded around on itself, for example, along the dashed lines (FIG. 1A). In FIG. 1A, an inner surface 110 of sheet/sidewall 100 is shown segregated into three portions 111, 112, 113 by the dotted lines. According to some preferred embodiments, an entirety of inner surface 110 can comprise a heat sealant layer and the dotted lines are employed merely to designate the edge portions 112 and 113 that come together and interface with one another to form a first sealed closure 15 of package 10, which can be seen in FIG. 1B. According to alternate embodiments, the dotted lines designate a limited extent of a heat sealant layer that overlies just one or both of edge portions 112, 113 of inner surface 110, for example, via spot application of sealant strips. With particular reference to the cross-section view of FIG. 1B, sealed closure 15, can be, for example, what is known as a fin seal to those skilled in the art, and can be and is typically formed by applying heat and pressure, by means of confronting clamp surfaces or seal jaws, to those portions of outer surface 120 that correspond to portions 112 and 113 of inner surface 110, when portions 112 and 113 are opposite one another, for example, in a vertical form, fill and seal machine, like that described below in conjunction with FIG. 3. Sealed closure 15 extends longitudinally and can and typically does extend along an entire length or height of package 10. According to some exemplary embodiments, the width "w" of sealed closure 15 can range from between approximately ⅜ inch (10 mm) and approximately ⅝ inch (16 mm)

With further reference to FIG. 1A, a material that forms mark 145 is preferably located on edge portion 113 of inner surface 110 of sheet/sidewall 100, and sheet/sidewall 100 is transparent in that area which coincides with edge portion 113 and mark 145, so that when edge portion 113 overlays and is seal adhered to edge portion 112, upon formation of sealed closure 15, mark 145 is visible from an opposite side of edge portion 113, for example, that forms outer surface 120 of sidewall 100 of package 10, as is illustrated in FIG. 1B. Alternately, a marking, material can be located/applied on edge portion 112 of inner surface 110, in which case sheet/sidewall 100 is also transparent in that area which coincides with edge portion 113 and the formed mark, so that the mark on edge portion 112 is visible, through the area, from outer surface 120 of package 10, when sealed closure 15 is formed.

Figure 2B:
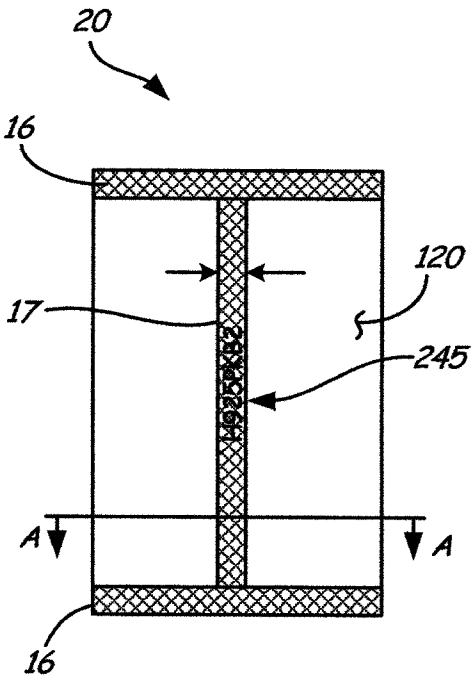
FIG. 2B is a plan view and a corresponding cross-section view of a package formed from the flexible sheet shown in FIG. 2A, according to some embodiments.
Figure 2B:
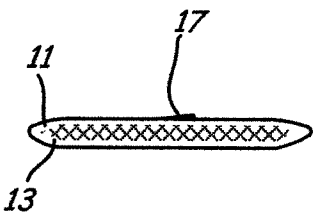
Figure 2A:
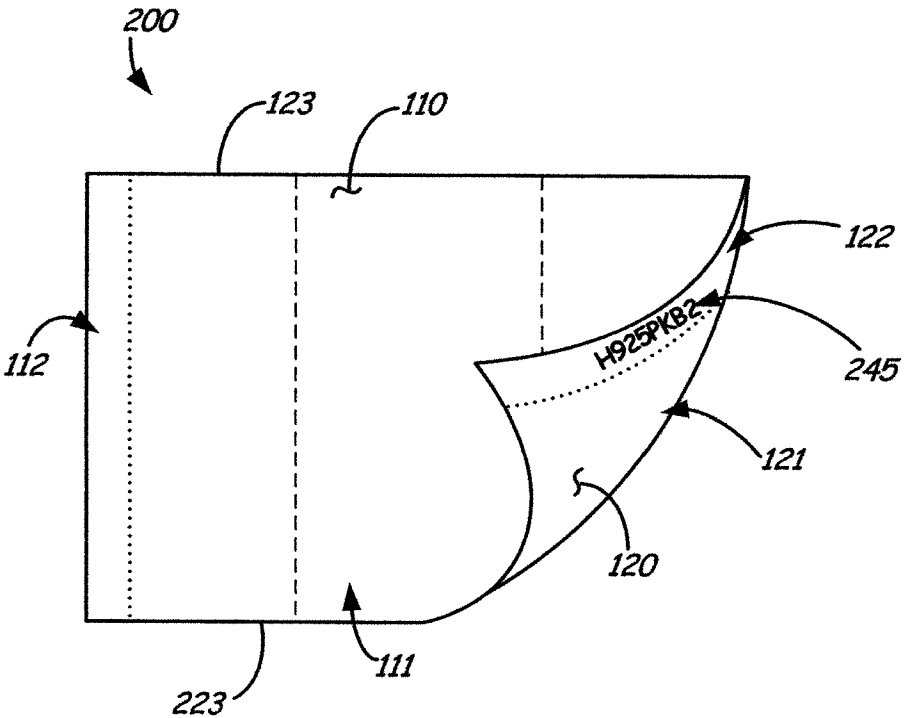
FIG. 2A is a plan view of another section or sheet fabricated from a flexible packaging material and including a mark formed thereon, according to some alternate embodiments.

FIG. 2A is a plan view of another section or piece of a flexible sheet 200 fabricated from a flexible packaging film material and having a mark 245 formed thereon, similar to sheet 100, but on outer surface 120 in an edge portion 122 thereof, for example, to accommodate formation of a sealed closure 17 as a lap seal rather than as a fin seal. FIG. 2B is a plan view and a corresponding cross-section view, along section line A-A of a package 20 formed from sheet 200, according to some embodiments wherein sealed closure 17 of package 20 is shown formed as a lap seal. In FIG. 2A, a corner of sheet 200 is conveniently shown lifted up and bent over so that both the inner surface 110 and outer surface 120 thereof can be seen. According to FIGS. 2A-B, sheet 200 is similar to sheet 100 in that sheet 200 forms a sidewall of package 20 having been wrapped or folded around on itself, for example, along the dashed lines (FIG. 2A). The dotted line on inner surface 110 of sheet/sidewall 200 segregates first and second portions 111, 112 thereof, and the dotted line on outer surface 120 of sheet/sidewall 200 segregates first and second portions 121, 122 thereof. According to some preferred embodiments, an entirety of each of inner surface 110 and outer surface 120 can include a heat sealant layer, and the dotted lines are employed merely to designate the edge portions 112 and 122 that come together and interface with one another to form sealed closure 17 of package 20. Alternately, a heat sealant layer can be limited to one or both of edge portions 112 and 122, as bounded by the dotted lines, for example, by the aforementioned spot application of sealant strips. With particular reference to the cross-section view of FIG. 2B, sealed closure 17, previously described as a lap seal, is typically formed by applying heat and pressure to a portion of outer surface 120, which is opposite portion 112 of inner surface 110 and which is supported at a portion of inner surface 110 that is opposite portion 122 of outer surface, when portion 112 overlaps and interfaces with portion 122, as shown in FIG. 2B. Like sealed closure 15, a width w of sealed closure 17 is between approximately ⅜ inch (10 mm) and approximately ⅝ inch (16 mm), according to some exemplary embodiments.

With further reference to FIG. 2A, a material that forms mark 245 is located on edge portion 122 of outer surface 120 of sheet/sidewall 200, and sheet/sidewall 200 is transparent in an area that coincides with edge portion 112 and mark 245, so that mark 245 is visible, through that area, from outer surface 120 of sidewall 200 of package 20, as illustrated in FIG. 2B. Alternately, a marking material is located/applied on inner surface 110 in edge portion 112, for example, to form a mark like mark 145 of FIG. 1A, in which case the area of sheet/sidewall 200, that coincides with edge portion 112 and the mark, is also transparent, so that the mark is visible therethrough from an opposite side of edge portion 112 that forms outer surface 120 of package 20, when sealed closure 17 is formed.

FIGS. 1B and 2B further illustrate additional, transversely extending, sealed closures 16 formed at either end of each of packages 10, 20, and between which the corresponding sealed closure 15, 17 extends, in order to completely enclose a containment volume 11 for a product within each of packages 10, 20. Sealed closures 16, are similar to sealed closure 15, in that sealed closures 16 can be formed by applied heat and pressure, between confronting clamp surfaces, as described above. With reference to FIG. 1B, it should be noted that sealed closures 16 of package 10 may cause sealed closure 15 to be folded over toward the right hand side of package 10, so that edge portion 113 of inner surface 110 overlays edge portion 112 of inner surface 110 and mark 145 is viewed through the sidewall 100, from an opposite side of edge portion 113 to which the marking material has been applied. Of course, sealed closures 16 may not cause sealed closure 15 to be preferentially folded in either direction, or may cause sealed closure 15 to fold over toward the left hand side of package 10, in which case, edge portion 112 overlays edge portion 113 and closure 15 may be lifted up to read mark 145 as illustrated in FIG. 1B. According to some alternate embodiments, a mark, either in addition to or as an alternative to mark 145, 245, is formed by a material located on inner surface 110, adjacent to one of edges 123, 223 (FIGS. 1A and 2A), so as to be contained within one of sealed closures 16 (FIGS. 1B and 2B), wherein the corresponding area of sidewall 100, 200 is transparent, so that the mark is visible from outer surface 120 of sidewall 100, 200 of package 10, 20.

Figure 4:
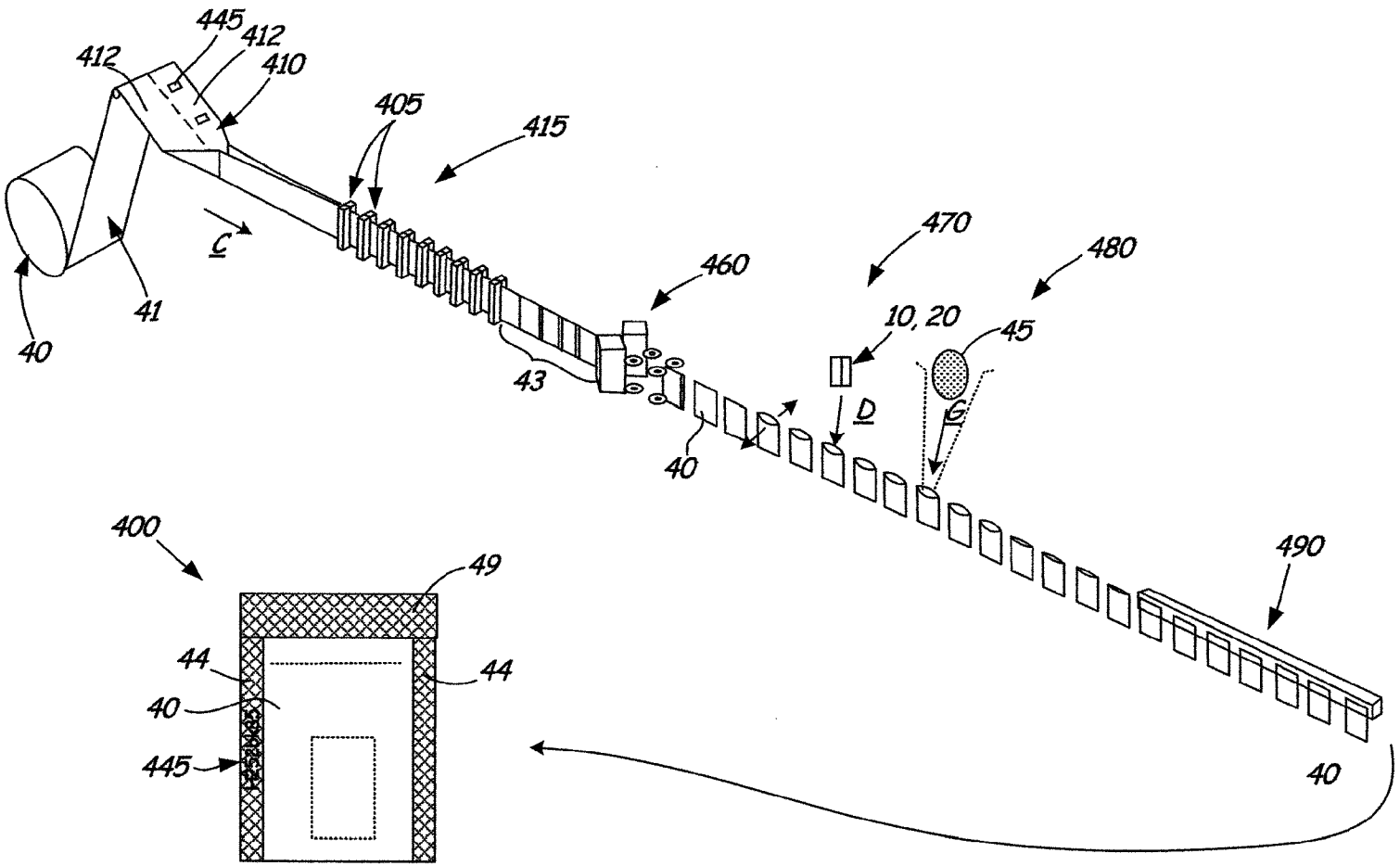
FIG. 4 is a schematic perspective view of steps carried out in another type of continuous production line that can be employed to manufacture some embodiments of the present invention, according to some methods of the present invention, along with a plan view of a resulting packaged product, according to some embodiments.

Containment volume 11 of packages 10, 20 preferably contains a quantity of product, which will be designated as an item 13 shown in FIGS. 1B, 2B. Item 13 can be: an edible food material, one or more pharmaceuticals, a cleaning material, a health and/or beauty material or a promotional or premium item (any of which can be in a liquid, solid, semi-solid or particulate form, for example), and each of packages 10, 20 can be intended for enclosure within an outer package 40 along with another quantity of the product, which will be designated as a substance 45, to form a 'pouch-within-a-pouch' packaged product 400, for example, as is shown in FIG. 4. Substance 45, like item 13, can be, for example, an edible food material, a pharmaceutical, a cleaning material, a health and/or beauty material or a promotional or premium item (any of which can be in a liquid, solid, semi-solid or particulate form, for example). The material forming each mark 145, 245 is contained within the corresponding sealed closure 15, 17 so that neither item 13 nor substance 45 is exposed thereto, thereby preventing interaction therebetween. Such interaction could degrade the integrity of mark 145, 245 over time, for example, so that mark 145, 245 eventually becomes illegible, and/or contaminates and/or otherwise degrades the integrity of substance 45. In one example both item 13 and substance 45 are edible ingredients for example, which form a mixture for making a baked good, such as cookies or muffins or a cake, and which contain a fat or an oil ingredient that could dissolve/degrade/absorb the material that is used for forming marks, if exposed thereto.

Many consumer packaged food items comprise two sealed pouches disposed within a carton, and, typically the carton is oversized to provide sufficient clearance for inserting the first and second pouches side-by-side therein. A first pouch can contain, for example, a dehydrated material such as dried pasta or dehydrated potatoes, or a dry' mix for baked goods. A second pouch can contain a seasoning sauce or a dry mix for preparing a seasoning sauce or a frosting component. In another variation, the first pouch can comprise an over-wrapped or pouched toy or premium (e.g., baseball card) and the second pouch can comprise a bag of breakfast cereal. However, according to embodiments of the present invention, by providing a composite product, for example, 'pouch-within-a-pouch' packaged product 400, the size of any supplemental packaging, such as a carton, can be reduced, since the aforementioned clearance for side-by-side insertion is not required for the single pouch-within-a-pouch product 400. Also, the technical difficulty of filling such cartons can be reduced. Such reduction in the difficulty of packaging can lead to allowing for faster fabrication line speeds and reduced costs from higher rates of throughput. Of course, outer package 40 of packaged product 400 can be formed to be a stand-up or self-supporting package without an outer carton, whereby additional packaging savings can be realized.

It should be noted that, in addition to the rectangular package configurations shown in FIGS. 1B and 2B, other packaging configurations can beneficially include a mark contained within a sealed closure thereof. For example, a sealed closure of a parallelogram shaped package, such as that described in U.S. Patent Application 2006/0285781 to Robert Zoss, entitled "EASY POUR BAG" and published on Dec. 21, 2009,can include a mark like mark 145 or 245. In still other variations, either of packages 10, 20 can be in the formed of a tube, or either of packages 10, 20 may include gusseted sidewalls such as employed for microwave popcorn products.

Figure 3:
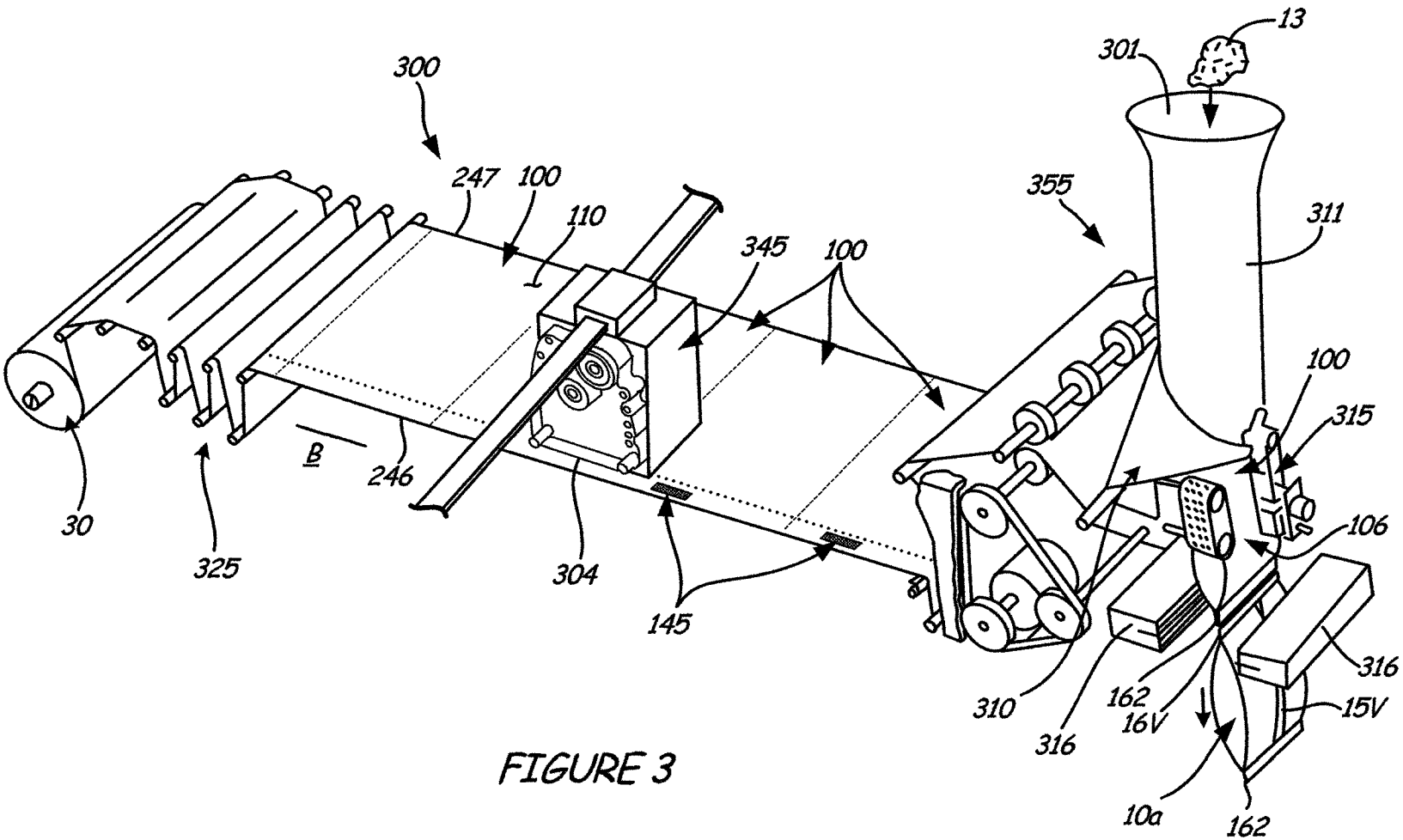
FIG. 3 is a schematic perspective view of a portion of a type of continuous production line that can be employed to manufacture some embodiments of the present invention, according to some methods of the present invention.

Sheet/sidewall 100, 200 can be any section or piece of a suitable flexible packaging film, especially plastic known in the art for packaging the above described types of items/substances. Examples of such suitable films can be polyethylene, polypropylene, polyester and blends thereof that include a heat sealant layer forming at least the surface on which a mark, for example, either of marks 145, 245, is formed. Some illustrative examples of suitable films include, without limitation: 1.) a laminated flexible packaging film including an outer polyethylene layer joined to a nylon layer by a first adhesive tie layer and a metallocene polyethylene heat sealant layer joined to the nylon layer by a second adhesive tie layer; 2.) a laminated flexible packaging film including a polyester layer joined to a metallocene polyethylene heat sealant layer by an adhesive tie layer; 3.) a film formed from a polyethylene co-extruded with an ethylene vinyl acetate, wherein the ethylene vinyl acetate forms a heat sealant layer; and 4.) a film formed from a polypropylene layer co-extruded with a polyethylene, wherein the polyethylene forms a heat sealant layer. In still other variations, the flexible packaging film can be formed of a material that seals to itself so that no separate sealant layer is necessary, for example, a polypropylene structure, or can be of increasingly popular biodegradable packaging films, for example, comprising poly lactic acid (PLA). According to some preferred methods of the present invention, a plurality of sheets/sidewalls 100, 200 are continuous with one another, being provided from a web, or ribbon of flexible sheet-like material that is wound about a roll, for example, roll 30 illustrated in FIG. 3. FIG. 3 is a schematic perspective view of a portion of an exemplary continuous packaging production line 300 that can be employed to manufacture a plurality of packages 10 from sheets 100 that are sequentially drawn from roll 30. FIG. 3 will be described in greater detail below.

The marking material for forming any of the aforementioned marks, for example, marks 145, 245, can be any suitable ink. According to some embodiments a dry ink which is bonded to a carrier ribbon is applied to sheet/sidewall 100, 200 to form mark 145, 245, for example, via hot stamp printing/embossing, or, preferably, via thermal transfer. According to other embodiments a water- or solvent-based ink is applied to sheet/sidewall 100, 200 to form mark 145, 245, for example, via ink jet printing. Although FIGS. 1A-B and 2A-B illustrate marks 145, 245 as being positively formed from a material, such as one of the aforementioned inks, according to some alternate embodiments, marks 145, 245 are formed by removing pre-determined portions of a pre-applied marking material, for example, by laser etching, so that remaining portion of the material outlines the mark; the pre-applied material can be an ink, water- or solvent-based, or a metal film applied, for example, via vapor deposition. In some embodiments, wherein a particular desired type of ink does not adequately adhere to the corresponding surface of a selected film for sheets 100, 200, a surface energy of the surface of the film can be adjusted, for example, via corona treatment, by methods known to those skilled in the art.

Although FIGS. 1A-B and 2A-B illustrate marks 145, 245 as a closed code date type mark, which type is known in the art for communicating information that is useful for manufacturing traceability, embodiments of the present invention can include any type of communicative mark and/or merely decorative mark. Examples of other types of marks that communicate information include, without limitation, a date (i.e. expiration date), usage instructions (i.e. a recipe), a name or identification label and a promotional message. Other types of inks for forming these other types of marks and/or marks 145, 245 are also contemplated, for example, a phosphorescent ink that glows in the dark, or a temperature sensitive/thermochromatic ink, that becomes visible at a pre-determined temperature, such as is supplied by Chromatic technologies, Inc. and Sun Chemical.

In FIG. 3, a schematic representation of a vertical form/fill/seal machine 355 and of a thermal transfer printer 345 are shown integrated together into a packaging production line 300, in which a plurality of marked packages, for example, like package 10 (FIG. 1B), are sequentially formed, according to some methods of the present invention. In an exemplary embodiment, machine 355 is a Hayssen Vertical Form/Fill/Seal machine, Model ULTIMA®SV 12-16HR (available from HayssenSandiacre of Duncan, South Carolina), and thermal transfer printer 345 is a Norwood Thermal Transfer Unit, model no. 53LT, in which Norwood R129 Food Grade Ink Ribbon (carrying the aforementioned dry ink) is employed (both available from Norwood, a division of Illinois Tool Works). It should be noted that, although the description below corresponds to vertical form-and-fill packaging techniques and apparatus, those skilled in the art will appreciate that methods of the present invention may also be employed with horizontal form-and-fill packaging apparatus and techniques. Such horizontal form-and-fill apparatus and techniques are commonly employed for solid products, for example, wherein items are in bar form, such as granola or candy bars or bar soap.

FIG. 3 illustrates each section/sheet of flexible sheet-like material 100 (segregated by dashed lines that generally correspond to edges 123 and 223 of FIGS. 1A and 2A) being successively drawn, by machine 355, from roll 30 of a web of the sheet-like material (i.e., any of the previously described exemplary films) and through tension rollers 325, and then beneath a ribbon 304 of thermal transfer printer 345, per arrow B; the aforementioned dry ink is transferred from a lower portion of ribbon 304 of printer 345 to inner surface 110 of each sheet 100, in order to form each mark 145, and, for the purpose of illustration, in order to see ribbon 304 in FIG. 4, a cover of printer 345 has been removed from over the mechanism of printer 345 that guides ribbon 304. It should be noted that, with the cover of printer 345 in place during normal production line operation, only the lower portion of ribbon 304, which interfaces with inner surface 110 of sheets 100 during printing, is exposed, so that the cover prevents any loose particulates that can be within printer 345 from contaminating the facing inner surface 110 of sheets 100. FIG. 3 further illustrates the web of sheet-like material being drawn, downstream of printer 345, between a forming collar 310 and a forming insert 311 of machine 355, which together wrap each sheet 100 into a tubular form for sealing and filling. According to FIG. 3, machine 355 includes a vertical sealing tool 315, for example, to form a sealed closure like sealed closure 15 of FIG. 1B, and a horizontal sealing tool 316, for example, for forming a sealed closure like sealed closures 16 of FIG. 1B; forming insert 311 includes a lumen or fill tube 301 to act as a hopper for filling successive packages 10, for example, with item 13 (FIG. 1B), after sealed closures 15 and 16 are formed.

The dotted line of FIG. 3, which extends along inner surface 110 of sheets 100, parallel to and in proximity with a free edge 246 thereof, generally corresponds to the dotted line of FIG. 1A that segregates portion 111 from edge portion 113 of inner surface 110, to designate the location of mark 145 on each sheet/sidewall 100. According to some preferred methods, printer 345 is pre-programmed to apply ink in the form of marks 145 at predetermined intervals, which are established according to package size and according to a rate at which machine 355 draws sheets 100 from roll 30. Alternately, registration spots can be pre-formed on sheets 100 and an optical detector can be employed to detect each spot and trigger printer 345, in response to the detection. In either case, marks 145 are spaced apart from one another, lengthwise, by a distance that is compatible with the package size, thereby assuring that at least one full mark 145 will be contained in the subsequently-formed sealed closure 15 of each package 10, for example, as illustrated in FIG. 1B. According to some methods, each mark 145 is formed simultaneously with the filling of a partiallysealed package (i.e. package 10*b*) downstream. It should be noted that thermal transfer printer 345 preferably includes an onsite control unit (not shown), which provides an interface for an operator of production line 300 to digitally control the form/content of mark 145, as well as the interval at which marks are applied. According to alternate methods, different types of printers, such as a Norwood Hot Stamp Coder, Model No. AKS-15 with 172-218 Hot Stamp Ribbon, or a VideoJet ink jet printer, model no. Excel 17, with Food Grade VideoJet ink, can be integrated, with machine 355, into production line 300, being supported by a gantry in a manner similar to that shown for thermal transfer printer 345.

With further reference to FIG. 3, each marked sheet 100 is then successively drawn downstream to be formed in between insert 311 and collar 310 and then sealed, such that the material forming mark 145 is contained within each sealed closure 15 (FIG. 1B). In some instances, in order to assure that each mark is completely contained within the width of the corresponding sealed closure of each package, stationary clips or guides (i.e. a web tracking device known in the art; not shown) can be positioned along line 300, between tension rollers 325 and printer 345, at opposing free edges 246, 247 of sheets 100 to prevent sheets from wandering in a direction transverse to that indicated by arrow B. Each of vertical sealing tool 315 and horizontal sealing tool 316 includes confronting clamp surfaces to form fin seals, for example, of sealed closures 15 and 16, respectively, as previously described. Inner surface 110 of sheets 100, as previously described, is preferably formed by a heat sealant layer (i.e. metallocene polyethylene or ethylene vinyl acetate) so that sealing tools 315, 316 can employ resistive or ultrasonic means, or any other means known to those skilled in the art, to carrying out heat sealing for sealed closures 15, 16, according to methods known in the art. However, it is contemplated that a cold seal adhesive, for example, a latex-based or synthetic blend that is latex-free, can be employed as an alternative to heat sealing, as long as the cold seal adhesive does not obscure viewing of the mark that is formed by the material contained within the sealed closures.

Once horizontal sealing tool 316 and vertical sealing tool 315 form a partially sealed package, for example, having a lower transverse sealed closure 16L and at least a portion of the vertically extending sealed closure 15V, the package is filled with a quantity of the product, for example, item 13 via fill tube 301. After filling, each partially formed package 10, which has the filled item disposed therein, is drawn downward so that, if necessary, a remaining portion of the vertical sealed closure is formed, and an upper transverse sealed closure 16U is formed, to completely seal the package, as is shown for the package designated as 10*a* in FIG. 3. According to FIG. 3, sealing tool 316 simultaneously creates the upper transverse sealed closure 16U of package 10*a* and the lower transverse sealed closure 16L of the next succeeding package. Sealing tool 316 can employ a cutter or a knife that either makes a perforation between sealed closures 16L and 16U or completely severs package 10*a* from the next succeeding package. If the former, a group of packages 10 that are completed in production line 300 are collected as a plurality of detachably joined units, in the form of what is known as a bandolier strip with a line of perforations formed between each adjacent sealed closures 16L and 16U; whereas, if the latter, a group of packages 10, which are completed in packaging production line 300 and completely severed from one another, can be individually collected into a bin. In one variation (not shown), upper transverse sealed closure 16U can include a re-closure feature. In another variation (not shown) each package 10, and/or package 20, can include a notch or perforation formed in sheet/sidewall 100/200 in order to facilitate opening of the package.

According to some preferred methods, the packages completed in production line 300 are transferred to a second production line, where each package 10/20 is inserted into a corresponding outer package 40 to form pouch-within-a-pouch packaged product 400. It will be appreciated that the second production line can be located remotely from the first production line 300, even located at another production facility. FIG. 4 presents, schematically, exemplary steps performed in the second production line, along with a plan view of packaged product 400, according to some embodiments.

Suitable horizontal form, fill and seal equipment for this other production line is know in the art, an example of which includes the PowerPouch® Intermittent Motion Packager available from Southern Packaging Machinery of Athens, Ga.

FIG. 4 illustrates a web of flexible sheet-like material 41 being drawn from a roll 40, in a direction indicated by arrow C, and folded along the dashed line such that a side 410 of material 41 corresponds to an inner surface of each of the resulting outer packages 40, wherein the inner surface includes opposing portions 411 and 412. Once folded, a plurality of pairs of confronting clamps 405, which are included in a vertical sealing station 415, seal together opposing portions 411, 412 to forma series of connected pouches 43, which are subsequently separated from one another to form corresponding outer packages 40, for example, at a cutting station 460 that is schematically shown downstream of clamps 405. According to FIG. 4, a mouth of each outer package 40 is then progressively widened to, first, receive insertion, in a downward direction indicated by arrow D, of an inner package therein, for example, one of packages 10, 20 at a first filling station 470, and to subsequently receive another element of the resulting packaged product 400, for example, substance 45 via a funnel-shaped hopper at a second filling station 480, per the direction indicated by arrow E. Downstream of second filling station 480, a top sealing station 490 forms a sealed closure 49 of each outer package 40, so that each allocation of substance 45 and each corresponding inner package 10, 20 are enclosed together within the corresponding outer package 40 to form at least a part of resulting corresponding packaged product, for example, like packaged product 400. As previously described, mark 145, 245 of inner package 10, 20 is contained within one of the sealed closures thereof so that enclosed substance 45 does not contact, contaminate or interface with the material forming mark 145, 245. In FIG. 4, the single horizontal phantom line of packaged product 400 represents a top surface of the enclosed substance 45, which can be in a liquid, solid, semi-solid or particulate form, and the phantom-line rectangle of packaged product 400 represents the enclosed inner package 10, 20 directly interfacing with substance 45. According to an exemplary embodiment, item 13 enclosed within package 10, 20 comprises a topping of sugar and spices, and substance 45 is a mix of ingredients for making cookies, or some other type of baked good, to which the topping/item 13 can be applied.

FIG. 4 further illustrates outer package 40 of packaged product 400 including an optional mark 445, according to some alternate embodiments, wherein one of a pair of edge seals 44, for example, formed at vertical sealing station 415, contains optional mark 445. Thus, the material forming optional mark 445 is neither exposed to the contents of outer package 40 nor to other elements that can interface with the outer surface of outer package 40. With reference to the schematic production line of FIG. 4, a plurality of marks 445 are shown formed by a material applied to portion 412 of inner surface/side 410 of the web of flexible sheet-like material 41 at spaced apart intervals, for example, having been applied prior to the above-described folding step (upstream of arrow C in FIG. 4). The material forming optional marks 445 and the method for forming marks 445; as well as the form/type of marks 445 can correspond to any of the embodiments of, and methods for forming marks 145, which are described above; and, likewise, sheet-like material 41 can be any of the exemplary polymer films described above for sheets/sidewalls 100, 200. Furthermore, it should be noted that each area of the material 41, which corresponds with the other portion 411 of inner surface/side 410 that is opposite optional mark 445, is transparent so that mark 445 is visible from an outer surface of each outer package 40. Although FIG. 4 has been used to define an exemplary method for forming outer packages of packaged products, it should be understood that inner packages, according to alternate embodiments of the present invention, can be formed in a similar manner, rather than by the method described in conjunction with FIG. 3.

Finally, since another purpose for containing each of marks 145, 245, 445 within the corresponding sealed closure 15, 17, 44 can be to secure each mark from tampering therewith, from the outside of the corresponding package 10, 20, 40, additional embodiments of the present invention include packages, for example, like package 40, formed according to the method depicted in FIG. 4, which include mark 445 but do not necessarily contain inner package 10, 20. Furthermore, package 10, 20 need not be intended for containment within an outer package, such as package 40, in order to form a packaged product. Yet another purpose for containing marks, such as marks 145, 245, 445, within sealed clostres of packages can be to alert either the supplier or the consumer of the package that the integrity of a sealed closure has been compromised, for example, if the mark becomes illegible or otherwise significantly changes, such as in form or color, when the corresponding sealed closure is breached.

In the foregoing detailed description, the invention has been described with reference to specific embodiments. However, it can be appreciated that various modifications and changes can be made without departing from the scope of the invention as set forth in the appended claims.

The invention claimed is:

1. A package fabricated from a flexible packaging material and enclosing a containment volume for a product, the package comprising:

a flexible sidewall of the flexible packaging material for enclosing the volume, the sidewall including an inner surface, an outer surface and a sealed closure, the inner surface including a first portion, a second edge portion and a third edge portion, the outer surface including a first portion and a second edge portion, the first portion of the inner surface directly interfacing with the containment volume, and the second edge portion of the inner surface interfacing with one of: the third edge portion of the inner surface and the second edge portion of the outer surface, to form the sealed closure; and a material forming a mark on the flexible sidewall, the material being contained within the sealed closure; and wherein the flexible sidewall is transparent in an area coinciding with the contained material forming the mark so that the mark is visible from the outer surface of the sidewall.

2. The package of claim 1, wherein the flexible sidewall comprises a polymer film that includes a heat sealant layer forming at least the second edge portion of the inner surface of the sidewall.

3. The package of claim 1, wherein the material is one of:

a dry ink having been bonded to a carrier ribbon and then applied via thermal transfer or hot stamp printing; and a water- or solvent-based ink having been applied via ink jet printing.

4. The package of claim 1, wherein:

the mark is formed by removing pre-determined portions of a pre-applied material so that the material is a remaining portion of the pre-applied material and forms an outline of the mark; and the pre-applied material comprises one of an ink and a metal film.

5. The package of claim 1, wherein the mark communicates at least one of the following: a code for traceability, a date, usage instructions, a name or identification label for the product and a promotional message.

6. The package of claim 1, wherein the mark is decorative.

7. The package of claim 1, wherein the second edge portion of the inner surface interfaces with the third edge portion of the inner surface to form a fin seal as the sealed closure.

8. The package of claim 7, wherein:

the flexible sidewall comprises a polymer film that includes a heat sealant layer forming the inner surface of the sidewall;

the sealed closure is folded over such that the third edge portion of the inner surface of the sidewall overlays the second edge portion of the inner surface of the sidewall; and the material forming the mark is applied to the third edge portion of the inner surface of the flexible sidewall.

9. The package of claim 1, wherein the second edge portion of the inner surface interfaces with the second edge portion of the outer surface to form a lap seal as the sealed closure.

10. The package of claim 9, wherein:

the flexible sidewall comprises a polymer film that includes a heat sealant layer forming the inner surface of the sidewall and the outer surface of the sidewall; and the material forming the mark is applied to the second edge portion of the inner surface of the flexible sidewall.

11. The package of claim 1, further comprising a cold seal adhesive contained within the sealed closure.

12. The package of claim 1, wherein the containment volume contains a quantity of the product.

13. A packaged product comprising:

an outer package defining a first volume;

an inner package defining a second volume and being contained within the first volume; and a first quantity of the product contained in the first volume defined by the outer package;

a second quantity of the product contained in the second volume defined by the inner package; and wherein the inner package comprises:

a flexible sidewall of a flexible packaging material enclosing the second volume, the sidewall including an inner surface, an outer surface and a sealed closure, the inner surface including a first portion, a second edge portion and a third edge portion, and the outer surface directly interfacing with the first quantity of product and including a first portion and a second edge portion, the first portion of the inner surface directly interfacing with the second quantity of product contained within the second volume, and the second edge portion of the inner surface interfacing with one of: the third edge portion of the inner surface and the second edge portion of the outer surface, to form the sealed closure; and a material forming a mark on the flexible sidewall, the material being contained within the sealed closure; and wherein the flexible sidewall of the inner package is transparent in an area coinciding with the contained material forming the mark so that the mark is visible from the outer surface of the sidewall.

14. The packaged product of claim 13, wherein the first quantity of product contained in the first volume defined by the outer package comprises at least one of the following: an edible material, a pharmaceutical, a cleaning material, a health and/or beauty material and a promotional or premium item.

15. The packaged product of claim 13, wherein the second quantity of product contained in the second volume enclosed by the sidewall of the inner package comprises at least one of the following: an edible material, a pharmaceutical, a cleaning material, a health and/or beauty material and a promotional or premium item.

16. The packaged product of claim 13, wherein the flexible sidewall of the inner package comprises a polymer film that includes a heat sealant layer forming at least the second edge portion of the inner surface of the sidewall.

17. The packaged product of claim 13, wherein the material of the inner package is one of:

a dry ink having been bonded to a carrier ribbon and then applied via thermal transfer or hot stamp printing; and a water- or solvent-based ink having been applied via ink jet printing.

18. The packaged product of claim 13, wherein:

the mark of the inner package is formed by removing pre-determined portions of a pre-applied material so that the material is a remaining portion of the pre-applied material and forms an outline of the mark; and the pre-applied material comprises one of: an ink and a metal film.

19. The packaged product of claim 13, wherein the mark of the inner package communicates at least one of the following: a code for traceability, a date, usage instructions, a name or identification label for the product and a promotional message.

20. The packaged product of claim 13, wherein the mark of the inner package is decorative.

21. The packaged product of claim 13, wherein the second edge portion of the inner surface of the sidewall of the inner package interfaces with the third edge portion of the inner surface to form a fm seal as the sealed closure of the inner package.

22. The packaged product of claim 21, wherein:

the flexible sidewall of the inner package comprises a polymer film that includes a heat sealant layer forming the inner surface of the sidewall;

the sealed closure of the inner package is folded over such that the third edge portion of the inner surface of the sidewall overlays the second edge portion of the inner surface of the sidewall; and the material forming the mark of the inner package is applied to the third edge portion of the inner surface of the flexible sidewall.

23. The packaged product of claim 13, wherein the second edge portion of the inner surface of the sidewall of the inner package interfaces with the second edge portion of the outer surface to form a lap seal as the sealed closure.

24. The packaged product of claim 23, wherein:

the flexible sidewall of the inner package comprises a polymer film that includes a heat sealant layer forming the inner surface of the sidewall and the outer surface of the sidewall; and the material forming the mark of the inner package is applied to the second edge portion of the inner surface of the flexible sidewall.

25. The packaged product of claim 13, wherein the inner package further comprises a cold seal adhesive contained within the sealed closure of the inner package.

* * * * *